US006374660B1

(12) United States Patent
Palmgren

(10) Patent No.: US 6,374,660 B1
(45) Date of Patent: Apr. 23, 2002

(54) SLIDE HAMMER QUICK ATTACHMENT APPARATUS

(76) Inventor: Carl Palmgren, P.O. Box 737, Petaluma, CA (US) 94952

( * ) Notice: Subject to any disclaimer, the term of this patent is extended or adjusted under 35 U.S.C. 154(b) by 0 days.

(21) Appl. No.: 09/860,922

(22) Filed: May 17, 2001

Related U.S. Application Data

(60) Provisional application No. 60/205,599, filed on May 17, 2000.

(51) Int. Cl.[7] ..... B21J 13/03

(52) U.S. Cl. ..... 72/481.1; 72/478; 72/479; 72/481.3; 72/482.94

(58) Field of Search ..... 72/478, 479, 481.1, 72/705, 481.3, 481.8, 482.94

(56) References Cited

U.S. PATENT DOCUMENTS 3,113,478 A * 12/1963 Hall, Jr. et al. ..... 72/479
4,122,699 A * 10/1978 Logson ..... 72/325
4,653,167 A * 3/1987 Mullins ..... 29/402.18

* cited by examiner

*Primary Examiner*—David Jones
(74) *Attorney, Agent, or Firm*—Johnson & Stainbrook, LLP; Larry D. Johnson; Craig M. Stainbrook

(57) ABSTRACT

A quick-release apparatus for use with slide hammers includes a shaft adapter portion which is threaded onto the slide hammer shaft and at least one tool adapter portion which is threaded onto the hook or tool to be used. The shaft adapter portion and tool adapter portion are mechanically engaged and disengaged by pulling down on the locking collar on the shaft adapter portion and turning the tool adapter portion ninety degrees, then sliding the tool adapter portion off the shaft adapter. The same or different tool can then be installed by aligning the shaft adapter lugs with the slots on the tool adapter and pushing the tool adapter on, then turning the tool adapter ninety degrees until the positioning lugs on the locking collar engage.

4 Claims, 3 Drawing Sheets

SLIDE HAMMER QUICK ATTACHMENT APPARATUS

This application claims the benefit of Provisional Application Ser. No. 60/205,599, filed May 17, 2000.

BACKGROUND OF THE INVENTION

1. Field of the Invention

This invention relates generally to hand tools and associated equipment for use in auto body repair and industry, and more specifically to an improved quick-release apparatus for use with slide hammers and the like.

2. Description of the Prior Art

Sliding hammers are commonly used in the auto body repair and other like industries to exert a controlled and localized impact to sheet metal, in order to remove dents and straighten or otherwise form the metal surface. Typically, one of various-sized hooks or other working tool is attached to the end of the slide hammer shaft by threading the hook or tool onto the shaft, then the hook or tool is engaged to the metal surface being repaired, and the slide hammer is manually actuated by the mechanic to progressively remove the dent or work the surface.

It is often necessary to change the hook or tool being used and replace it with another hook or tool of a different size or shape. However, because of the threaded nature of the attachment of the hook or tool and the shaft, changing of the hook or tool can be time-consuming and laborious. As a result, many mechanics forgo changing the hook or tool even when the job calls for such a change, resulting in a substandard work product.

SUMMARY OF THE INVENTION

The slide hammer quick attachment apparatus of this invention provides an improved quick-release apparatus for use with slide hammers and the like. The inventive apparatus includes a shaft adapter portion which is threaded onto the slide hammer shaft, and at least one tool adapter portion which is threaded onto the hook or tool to be used. The shaft adapter portion and tool adapter portion can then be mechanically engaged to each other and disengaged from each other by pulling down on the locking collar on the shaft adapter portion and turning the tool adapter portion (e.g., ninety degrees), then sliding the tool adapter off the shaft adapter. The same or a different tool (connected to its own tool adapter portion) can then be installed on the slide hammer by aligning the shaft adapter lugs with the slots on the tool adapter and pushing the tool adapter on, then turning the tool adapter (again, e.g., ninety degrees) until the positioning lugs on the locking collar engage.

The inventive attachment system thus enables quick on and quick off changes of slide hammer attachments for auto body repair and other industrial uses. The inventive apparatus saves the user both time and money, and reduces mechanic fatigue. Furthermore, the mechanic is much more likely to use the correct attachment for the slide hammer if it is not such a burden to change them.

DETAILED DESCRIPTION OF A PREFERRED EMBODIMENT

Figure 1:
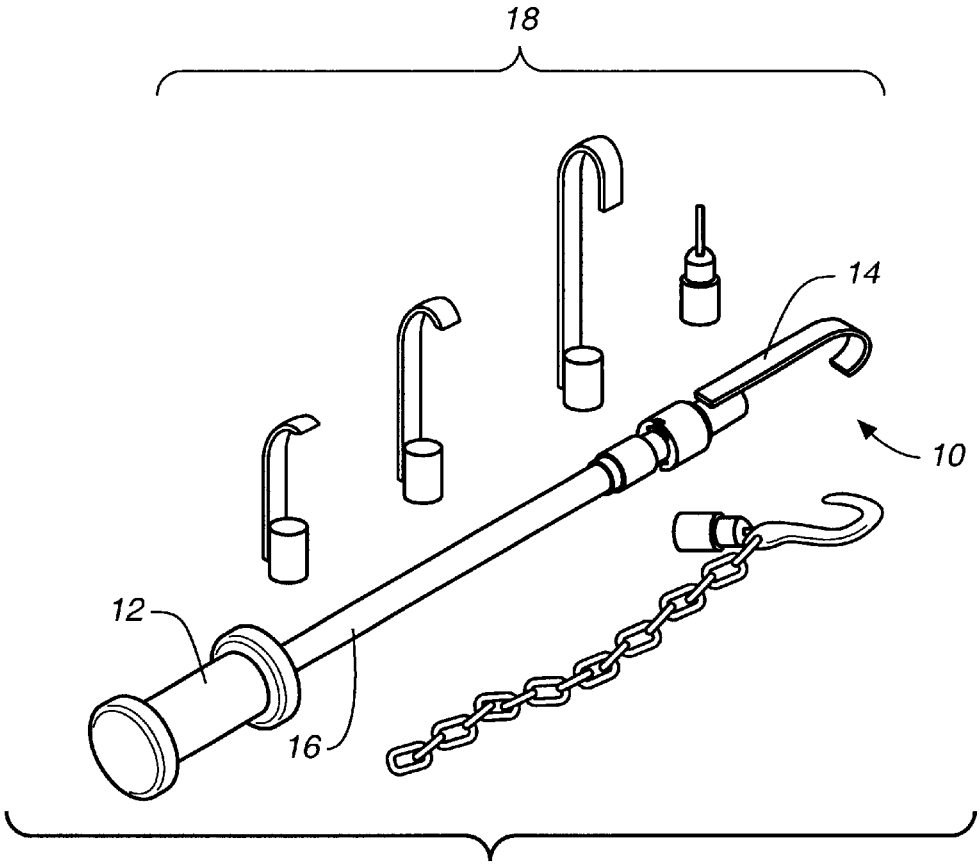
FIG. 1 is a perspective view of a slide hammer quick attachment apparatus of this invention as installed on a slide hammer to connect a tool to the slide hammer shaft, and further illustrating a variety of alternate tools that could similarly be installed.

FIG. 1 is a perspective view of a slide hammer quick attachment apparatus 10 of this invention as installed on a slide hammer 12 to connect a tool 14 to the slide hammer shaft 16, and further illustrating a variety of alternate tools 18 that could similarly be installed.

Figure 2:
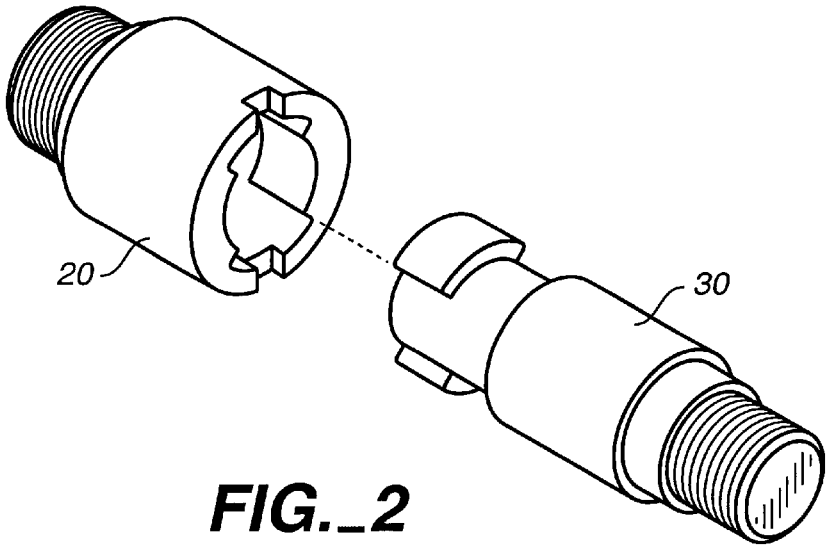
FIG. 2 is a perspective view of the tool adapter portion aligned with the shaft adapter portion for engagement.

FIG. 2 is a perspective view of the tool adapter portion 20 aligned with the shaft adapter portion 30 for engagement.

Figure 3B:
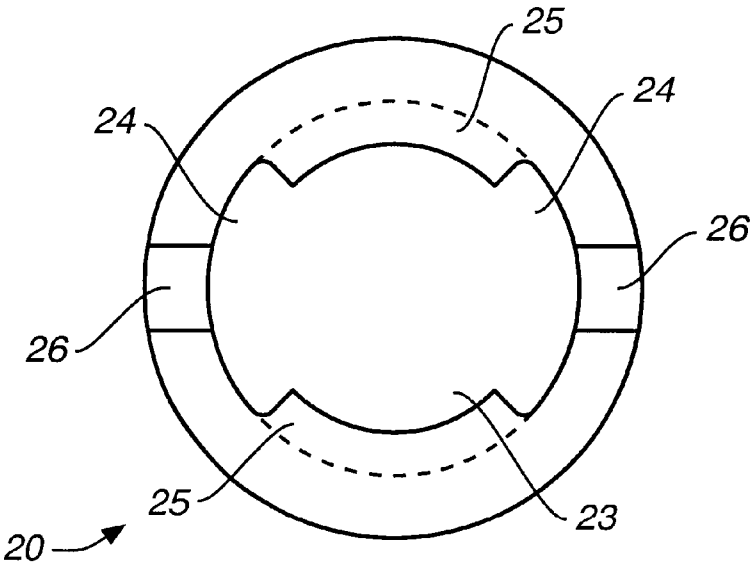
FIG. 3B is an end elevation view of the tool adapter portion.
Figure 3A:
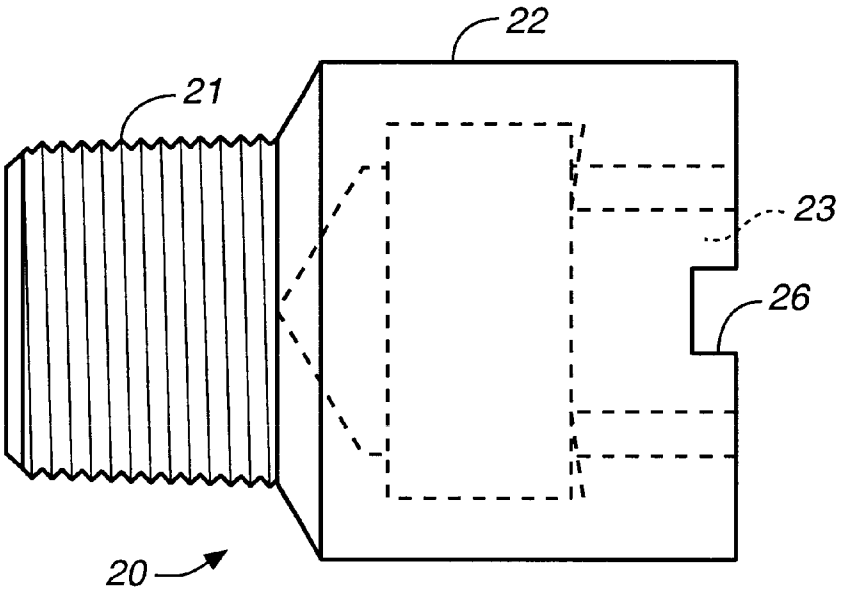
FIG. 3A is a side elevation view of the tool adapter portion.

FIG. 3A is a side elevation view of the tool adapter portion 20, while FIG. 3B is an end elevation view. Tool adapter 20 includes threaded end 21 for threaded attachment to any of a variety of hooks or tools. Body 22 includes a bore 23 adapted for insertion of the shaft adapter (FIGS. 4 and 4A), with slots 24 to accommodate the shaft adapter lugs, and flanges 25 to capture those lugs after insertion and turning. Slots 26 engage the positioning lugs on the locking collar (FIGS. 5 and 5A).

Figure 4B:
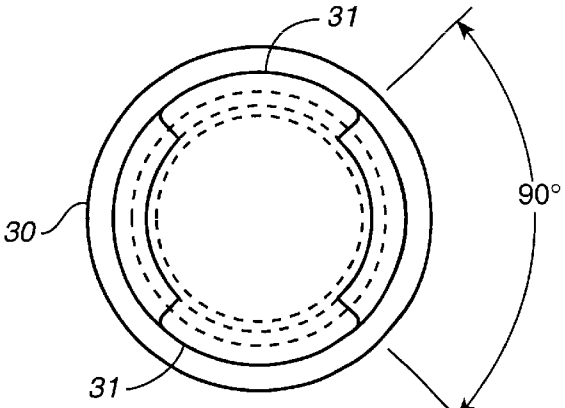
FIG. 4B is an end elevation view of the shaft adapter portion.
Figure 4A:
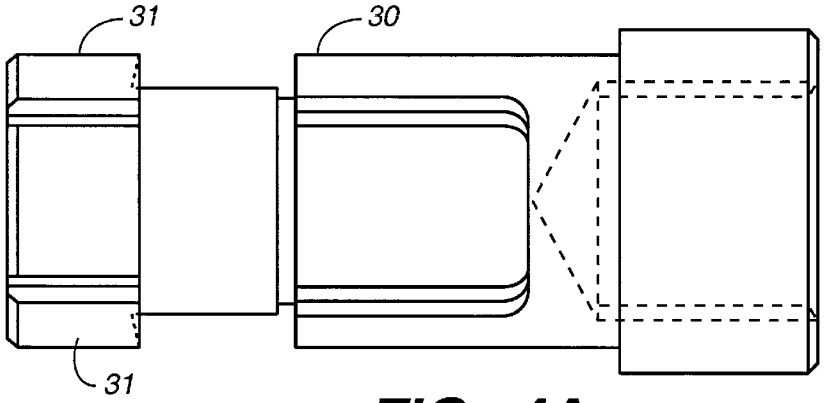
FIG. 4A is a side elevation view of the shaft adapter portion.

FIG. 4A is a side elevation view of the shaft adapter portion 30, while FIG. 4B is an end elevation view. Shaft adapter lugs 31 engage slots 24 on the tool adapter portion, and are captured by flanges 25 after insertion and turning.

Figure 5B:
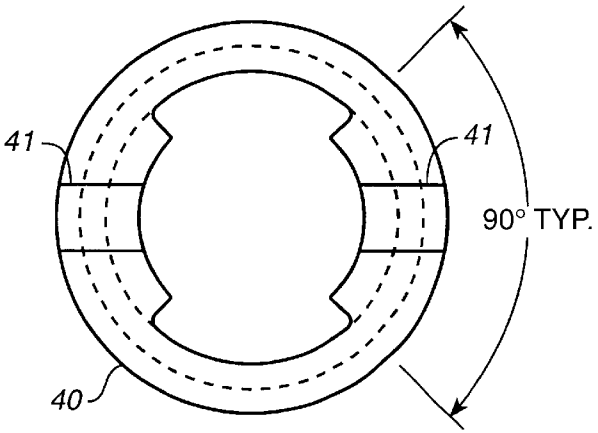
FIG. 5B is an end elevation view of the shaft adapter collar.
Figure 5A:
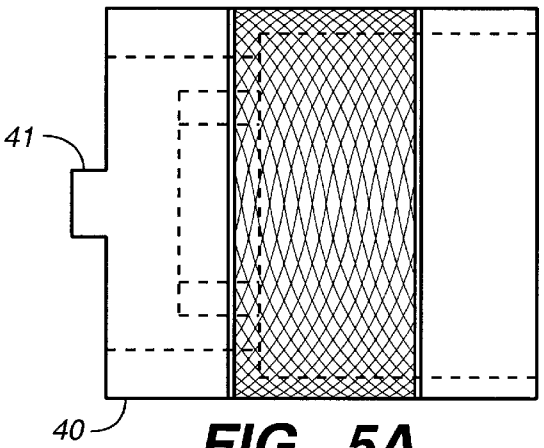
FIG. 5A is a side elevation view of the shaft adapter collar.

FIG. 5A is a side elevation view of the shaft adapter collar 40, while FIG. 5B is an end elevation view, both illustrating the collar as removed from the shaft adapter. When installed on the shaft adapter, collar 40 may be retracted relative to the shaft adapter to permit release of the tool adapter. The positioning lugs 41 engage the slots 26 in the tool adapter.

Features of the preferred embodiment of the invention include, but are not limited to:

1. heat treated alloy steel construction
2. dual heavy duty pulling lugs
3. sliding locking collar, spring loaded and knurled.
4. positioning lugs on locking collar
5. can be made in various sizes to fit large and small slide hammers.
6. shaft adapter portion can stay permanently on the shaft, tool adapter portion(s) can stay permanently on the selected tool(s).
7. the attachments (hooks and tools) may be produced with the proper adapter pre-installed.

While this invention has been described in connection with preferred embodiments thereof, it is obvious that modifications and changes therein may be made by those skilled in the art to which it pertains without departing from the spirit and scope of the invention Accordingly, the scope of this invention is to be limited only by the appended claims and their legal equivalents.

What is claimed as invention is:

1. A quick attachment apparatus for connecting a tool to a slide hammer, the slide hammer having a threaded shaft, the tool having a threaded socket, said apparatus comprising:

a shaft adapter portion for threading onto the slide hammer shaft;

a tool adapter portion for threading onto the tool;

means for mechanically engaging said shaft adapter portion and said tool adapter portion.

2. The quick attachment apparatus of claim 1 wherein said means for mechanically engaging said shaft adapter portion and said tool adapter portion comprises at least one lug on said shaft adapter portion engageable with at least one slot on said tool adapter portion.

3. The quick attachment apparatus of claim 2 wherein said means for mechanically engaging said shaft adapter portion and said tool adapter portion comprises a pair of lugs on said shaft adapter portion engageable with at least a pair of slots said tool adapter portion.

4. The quick attachment apparatus of claim 1 wherein said means for mechanically engaging said shaft adapter portion and said tool adapter portion includes a locking collar on said shaft adapter portion engageable with said tool adapter portion.

* * * * *